US008487538B2

(12) United States Patent
Li et al.

(10) Patent No.: US 8,487,538 B2
(45) Date of Patent: Jul. 16, 2013

(54) DRIVING POWER CONTROL CIRCUIT FOR LIGHT EMITTING DIODE AND METHOD THEREOF

(75) Inventors: Yueh-Han Li, Hsin-Chu (TW); Sheng-Kai Hsu, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 295 days.

(21) Appl. No.: 13/093,155

(22) Filed: Apr. 25, 2011

(65) Prior Publication Data

US 2012/0153846 A1 Jun. 21, 2012

(30) Foreign Application Priority Data

Dec. 21, 2010 (TW) ..... 99144954 A

(51) Int. Cl.
*H05B 37/00* (2006.01)
*H05B 39/00* (2006.01)
*H05B 41/00* (2006.01)

(52) U.S. Cl.
USPC ..... 315/185 R; 315/192; 315/193; 315/299; 315/301

(58) Field of Classification Search
USPC ..... 315/185 R, 192–193, 291, 294, 297, 315/299–302, 307–308
See application file for complete search history.

(56) References Cited

U.S. PATENT DOCUMENTS

2007/0171271 A1 7/2007 Wey et al.
2008/0094008 A1 4/2008 Liu
2008/0150877 A1 6/2008 Chao et al.
2009/0021183 A1 1/2009 Ye et al.
2009/0187925 A1 * 7/2009 Hu et al. ..... 719/327
2010/0327835 A1 * 12/2010 Archibald ..... 323/282
2011/0084620 A1 * 4/2011 Lee ..... 315/186

FOREIGN PATENT DOCUMENTS

| | | |
|---|---|---|
| CN | 101175346 | 5/2008 |
| CN | 101179882 | 5/2008 |
| CN | 101222801 | 7/2008 |
| CN | 101350176 | 1/2009 |
| CN | 101854758 | 10/2010 |
| TW | I255376 | 5/2006 |
| TW | M292167 | 6/2006 |
| TW | 200719296 | 5/2007 |
| TW | 200945942 | 11/2009 |

* cited by examiner

*Primary Examiner* — Anh Tran
(74) *Attorney, Agent, or Firm* — WPAT, PC; Justin King

(57) ABSTRACT

A driving power control circuit and method for light emitting diodes (LEDs) are provided. The driving power control circuit includes a plurality of switch units and a control unit. Each switch unit is electrically coupled to one LED string whose end generates node voltage. The control unit includes a voltage selecting module, a subtractor, and an adjusting module. The voltage selecting module is electrically coupled to the node voltages and outputs one of the node voltages as a reference node voltage. The subtractor is electrically coupled to an output terminal of the voltage selecting module and generates a corresponding feedback voltage according to the reference node voltage and the node voltage. The adjusting module is electrically coupled to an output terminal of the subtractor and outputs a corresponding adjusting signal according to the feedback voltage to determine whether the corresponding switch unit is turned on.

9 Claims, 4 Drawing Sheets

DRIVING POWER CONTROL CIRCUIT FOR LIGHT EMITTING DIODE AND METHOD THEREOF

BACKGROUND

1. Technical Field

The present invention generally relates to a driving power control circuit and a method thereof and, particularly to a driving power control circuit or light emitting diode (LED) and method thereof.

2. Description of the Related Art

LEDs are as new generation lighting components, they have the advantages of saving electricity and long useful life, and therefore they are widely used in various devices, especially used in backlight modules of flat-panel displays (e.g., liquid crystal displays). LED strings of the backlight modules can emit light through LEDs thereof driven by power driving circuits. But each LED string has different load characteristics; this results in that different LED strings cannot be effectively maintained to have their brightness in consistency. Moreover, too high temperature of the power driving circuits may be caused by power loss of electronic components in the power driving circuits.

Therefore, during the manufacture process of the power driving circuits for LEDs, stable current circuit and compensation power supply circuit are set in the power driving circuits, thereby providing stable current and compensated voltage to drive the LED strings. But using this method, ripple distortion problems may exist in power supply outputted by the power driving circuit, resulting in overheating and instability of the whole power driving circuit.

BRIEF SUMMARY

Accordingly, the present invention is directed to a driving power control circuit adapted to drive power supplies of a plurality of LED strings, in order to improve reliability of circuit and overcome heat loss problems generated by electronic components of the whole power driving circuit associated with the prior art.

The present invention is still directed to a driving power control method using the above-mentioned driving power control circuit, in order to overcome heat loss problems generated by electronic components of the whole power driving circuit associated with the prior art.

Specifically, a driving power control circuit for LEDs in accordance with an embodiment of the present invention includes a first power supply terminal, a second power supply terminal, a plurality of switch units, and a control unit. Wherein the first power supply terminal provides a first output voltage. The second power supply terminal provides a second output voltage. Each of the switch units is electrically coupled between a corresponding LED string and the second power supply terminal. Each of the LED strings is electrically coupled between one of the switch units and the first power supply terminal, to make the first power supply terminal, the corresponding LED string, the corresponding switch unit, and the second power supply terminal in parallel to form an electronic conducting path. The control unit is configured to output a plurality of adjusting signals to the corresponding plurality of switch units to determine whether the switch units are turned on. The control unit is also electrically coupled between the plurality of switch units and the corresponding LED strings to get the corresponding plurality of node voltages. Moreover, the control unit includes a voltage selecting module, a subtractor, and an adjusting module. The voltage selecting module receives the plurality of node voltages, selects one of these node voltages as a reference node voltage, and outputs the reference node voltage. The subtractor receives the reference node voltage and one of the node voltages, makes the node voltage to subtract the reference node voltage, and outputs a corresponding feedback voltage corresponding to the node voltage. The adjusting module is electrically coupled to the subtractor to receive the feedback voltage, and determines contents of the adjusting signals according to the feedback voltage.

In one embodiment of the present invention, the adjusting module includes a driving current adjusting module and a work signal generating module. The driving current adjusting module is electrically coupled to the subtractor to receive the feedback voltage, and determines current flowing through the corresponding switch unit according to the feedback voltage. The work signal generating module is electrically coupled to the driving current adjusting module, and determines work power sates of the plurality of switch units according to the currents flowing through each of the switch units.

In one embodiment of the present invention, each of the switch units includes a transistor, a resistor, and a comparator. The transistor includes a control terminal, a first pathway terminal electrically coupled to the corresponding LED string, and a second pathway terminal. The resistor includes one terminal electrically coupled to the second power supply terminal, and the other terminal electrically coupled to the second pathway terminal. The comparator includes a first comparison data input terminal electrically coupled to a reference node voltage, a second comparison data input terminal electrically coupled to the second pathway terminal of the transistor, and an comparison result output terminal electrically coupled to the control terminal. Moreover, the driving current adjusting module outputs the reference voltage to the first comparison data input terminal of the comparator.

In one embodiment of the present invention, the voltage selecting module selects the minimum voltage from these node voltages, and outputs the minimum voltage as the reference node voltage.

A driving power control method for LEDs in accordance with another embodiment of the present invention includes the following steps of: (1) getting a plurality of corresponding node voltages from ends of a plurality of LED strings; (2) getting one of these node voltages as a reference node voltage; (3) obtaining a plurality of voltage differences between these node voltages and the reference node voltage, and outputting the voltage differences as corresponding a plurality of feedback voltages; and (4) adjusting currents flowing through the corresponding LED strings according to these feedback voltages.

In one embodiment of the present invention, the reference node voltage is the minimum voltage of the plurality of node voltages.

In one embodiment of the present invention, the driving power control method for LEDs can further include the following steps of: providing a fixed slope line in characteristic curve of driving currents to node voltages of LED string; and finding a plurality of driving currents corresponding to the plurality of feedback voltages on the suggestion line according to the feedback voltages. At last, adjusting work time of the LED strings according to the adjusted driving currents, in order to make the plurality of LED strings to provide default brightness.

In the method of the invention to solving the problems associated with the prior art, a plurality of switch units are set at the ends of the plurality of LED strings. A control unit is set in the driving power control circuit, in order to drive the plurality of the LED strings to emit light and obtain node voltages. And the adjusting module set in the control unit can eliminate ripple of node voltages to get the feedback voltages, and can proceed with control operation in the characteristic curve of driving currents to node voltages according to the feedback voltages. Therefore, the invention of the driving power control circuit not only improve reliability of the circuit, but also can overcome heat loss problems of the electronic components caused by voltage differences.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

In the following detailed description of the preferred embodiments, reference is made to the accompanying drawings which form a part hereof, and in which are shown by way of illustration specific embodiments in which the invention may be practiced. It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Accordingly, the descriptions will be regarded as illustrative in nature and not as restrictive.

Figure 1:
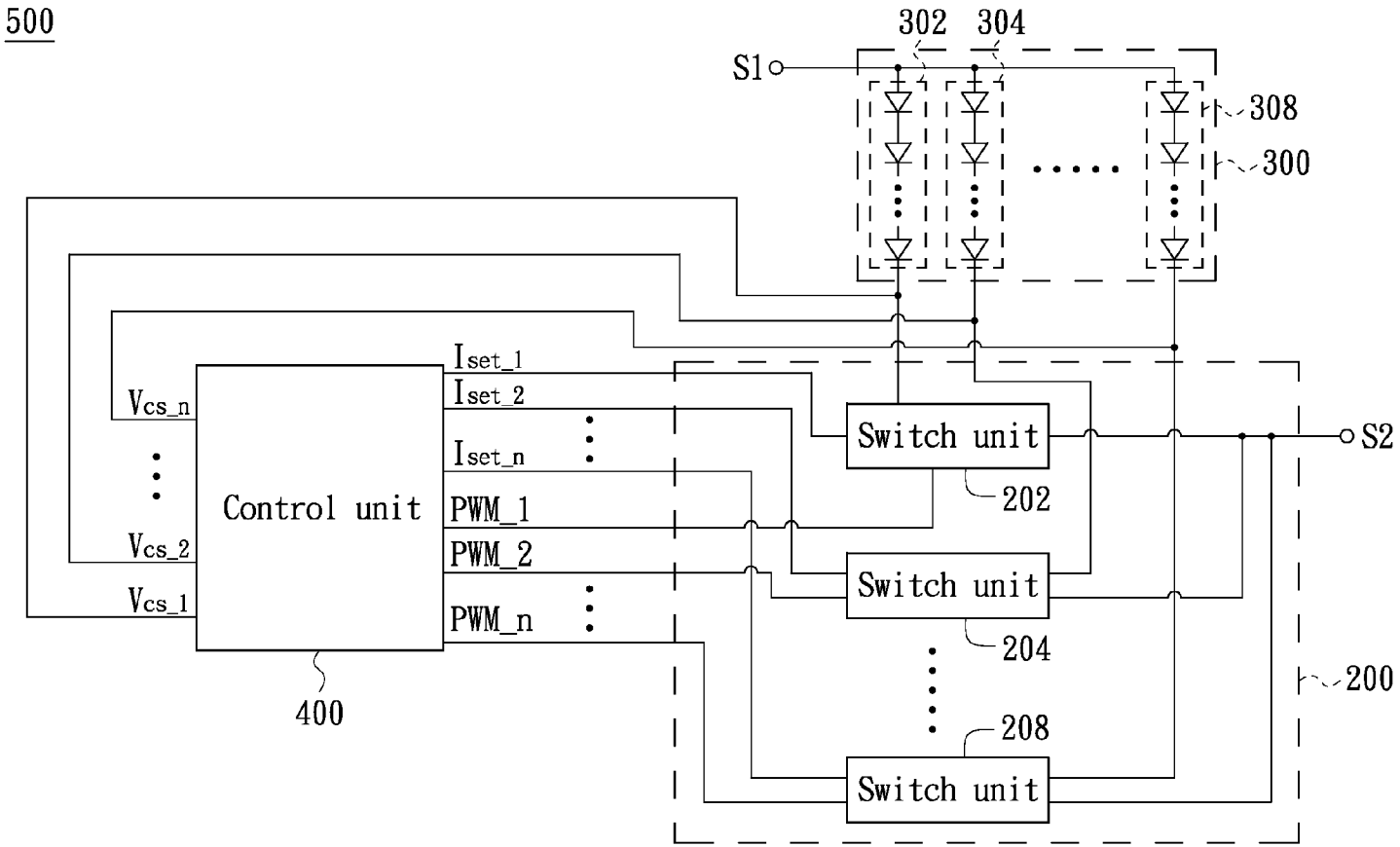
FIG. 1 shows a partial circuit diagram of a driving power control circuit for LEDs in accordance with an exemplary embodiment of the present invention.

Referring to FIG. 1, showing a partial circuit diagram of a driving power control circuit for LEDs in accordance with an exemplary embodiment of the present invention. The driving power control circuit 500 as shown in FIG. 1 applied to power driving circuits of all kinds of flat-panel displays (e.g., liquid crystal displays, LCDs), drives a plurality of LED strings 302, 304, . . . , and 308 of a backlight module 300 of a flat-panel display. The driving power control circuit 500 includes a first power supply terminal S1, a second power supply terminal S2, a control unit 400, and a switch unit group 200. The first power supply terminal S1 provides a first output voltage. The second power supply terminal S2 provides a second output voltage. The switch unit group 200 includes a plurality of switch units 202, 204, . . . , and 208. Each of the switch units 202-208 is respectively electrically coupled between one of the LED strings 302-308 of the backlight module 300 and the second power supply terminal S2. The control unit 400 receives node voltages $V_{cs_1}$, $V_{cs_2}$, . . . , and $V_{cs_n}$ between each of the switch units and corresponding LED strings, and outputs a plurality of adjusting signals including current adjusting signals $I_{set_1}$, $I_{set_2}$, . . . , and $I_{set_n}$ and work cycle adjusting signals PWM_1, PWM_2, . . . , and PWM_n, for determining whether the corresponding switch units 202~208 are turned on.

Figure 2:
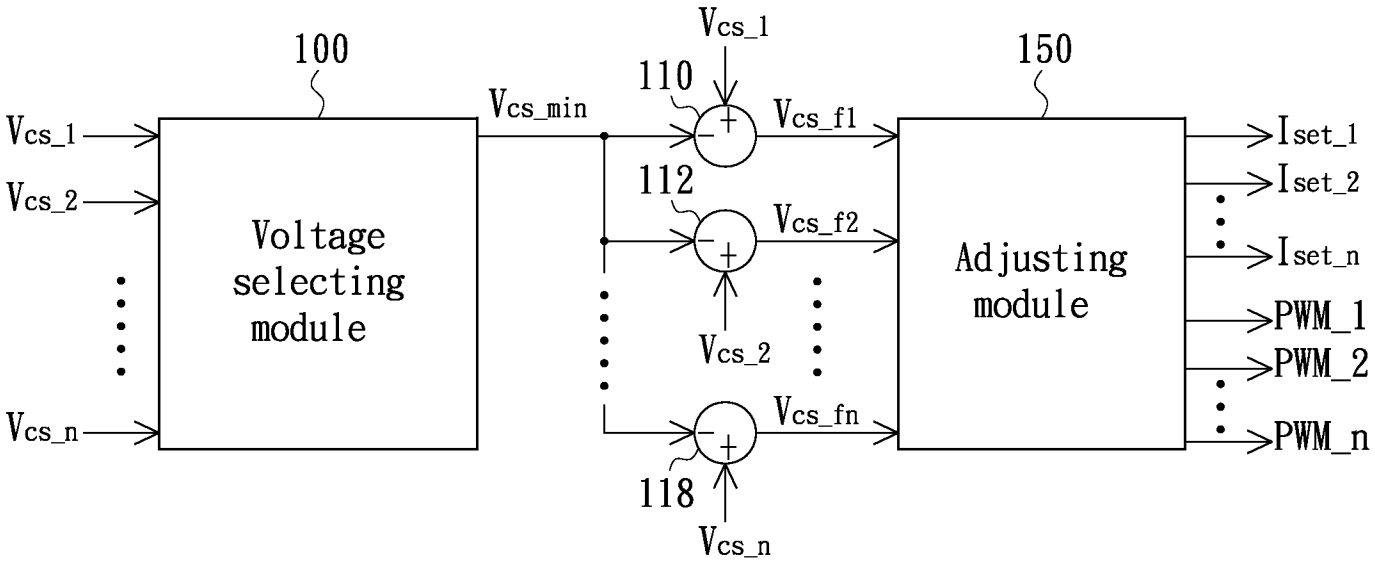
FIG. 2 shows a circuit diagram of a control unit in accordance with an exemplary embodiment of the present invention.

FIG. 2 shows a circuit diagram of a control unit in accordance with an exemplary embodiment of the present invention. In this embodiment, the control unit 400 includes a voltage selecting module 100, subtractors 110, 112, . . . , and 118, and an adjusting module 150. The voltage selecting module 100 receives a plurality of node voltages $V_{cs_1}$, $V_{cs_2}$, . . . , and $V_{cs_n}$, via conducting wires, selects minimum voltage from these node voltages, and outputs the minimum voltage as a reference node voltage $V_{cs_min}$. The subtractors 110~118 respectively receives node voltages $V_{cs_1}$, $V_{cs_2}$, . . . , and $V_{cs_n}$, via conducting wires, makes the node voltages $V_{cs_1}$, $V_{cs_2}$, . . . , and $V_{cs_n}$ to subtract the reference node voltage $V_{cs_min}$ respectively, and outputs corresponding feedback voltages $V_{cs_f1}$, $V_{cs_f2}$, . . . , and $V_{cs_fn}$. Thus, even if each of the node voltages $V_{cs_1}$, $V_{cs_2}$ . . . , and $V_{cs_n}$ is originally affected by ripple of the first output voltage, the subtraction operation of the subtractors can also eliminate the effect of the ripple. The adjusting module 150 is electrically coupled to the subtractors 110~118, to receive the feedback voltages $V_{cs_f1}$, $V_{cs_f2}$, . . . , and $V_{cs_fn}$, and to determine contents of the corresponding current adjusting signals $I_{set_1}$, $I_{set_2}$, . . . and $I_{set_n}$ and work cycle adjusting signals PWM_1, PWM_2, . . . and PWM_n according to the feedback voltages $V_{cs_f1}$, $V_{cs_f2}$, . . . and $V_{cs_fn}$.

Generally speaking, the number of the subtractors can be provided according to the number of the node voltages as shown in FIG. 2, to enable a subtractor to proceed with subtraction operations according to the reference node voltage and a node voltage of a certain particular node, and output a corresponding feedback voltage. Or, the number of the subtractors less than the number of the node voltages can also be provided, more than two node voltages can be provided to the same subtractor using multitask device, and the corresponding output feedback voltage is provided to the adjusting module 150, respectively, using the multitask device or a time difference method. The number of the subtractors and their connection relationships can also be changed on the premise that the corresponding feedback voltage generated by the certain node voltage is provided to the adjusting module 150.

Figure 3A:
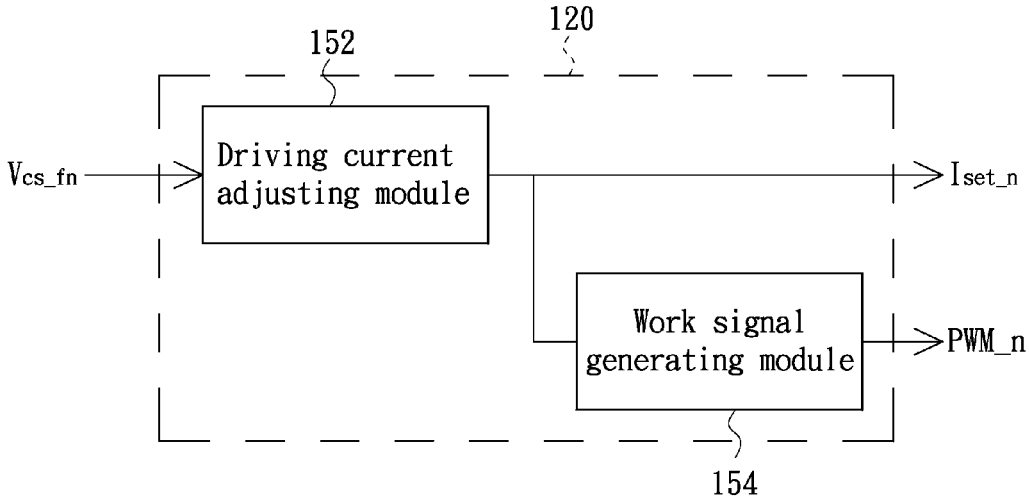
FIG. 3A shows a partial circuit block diagram of an adjusting module in accordance with an exemplary embodiment of the present invention.

FIG. 3A shows a partial circuit block diagram of an adjusting module in accordance with an exemplary embodiment of the present invention. The adjusting module of this embodiment includes a plurality of partial circuits 120, and each of the partial circuit 120 corresponds to an input feedback voltage. Each of the partial circuit 120 includes a driving current adjusting module 152 and a work signal generating module 154. Take the partial circuit 120 corresponding to the feedback voltage $V_{cs_fn}$ for an example, the driving current adjusting module 152 receives the feedback voltage $V_{cs_fn}$, and determines the output current adjusting signal $I_{set_n}$ according to the feedback voltage $V_{cs_fn}$. The work signal generating module 154 is electrically coupled to the driving current adjusting module 152 to receive the current adjusting signal $I_{set_n}$, and adjust state of the work cycle adjusting signal PWM_n according to the current adjusting signal $I_{set_n}$.

Figure 3B:
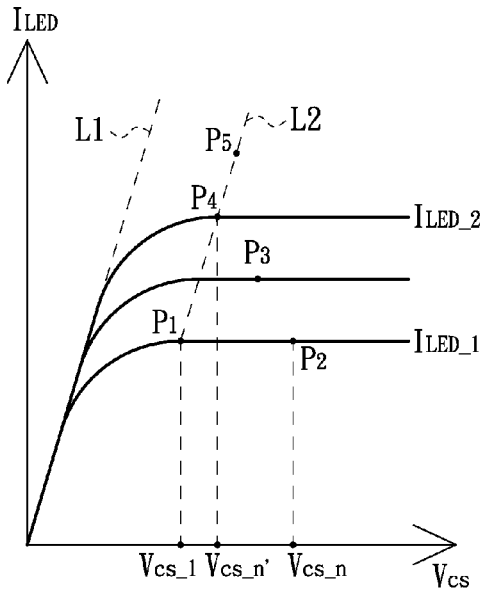
FIG. 3B shows a relationship graph between reference node voltage and currents flowing through the LED strings.
Figure 3C:
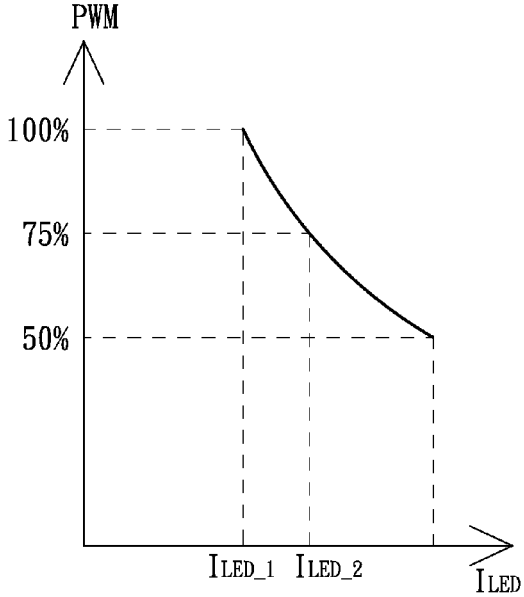
FIG. 3C shows relationship graph between currents flowing through the LED strings and work cycle adjusting signal required by corresponding switch unit.

Next, referring to FIG. 1, FIG. 3A, FIG. 3B, and FIG. 3C together, FIG. 3B shows a relationship graph between reference node voltage and currents flowing through the LED strings. FIG. 3C shows a relationship graph between currents flowing through the LED strings and work cycle adjusting signal required by corresponding switch unit. First, assuming the node voltage $V_{cs_1}$ is the minimum voltage of all the node voltages, the node voltage $V_{cs_1}$ will be the reference node voltage $V_{cs_min}$, and the corresponding LED driving current $I_{LED}$ will be current $I_{LED_1}$ flowing through the LED string 302. Secondly, suggestion line L2 is parallel to line L1, and passes through work point P1, and line L1 is a linear relationship line between node voltages and currents flowing through the LED strings and the extension line of the linear relationship line. The work point P1 is selected at a point which keeps fixed current even if node voltages are affected by ripple of the first output voltage.

Now on the assumption that FIG. 3B is in the above-mentioned situation, then the work point P1 will correspond to the node voltage $V_{cs_1}$ and the current flowing through the LED string 302. At the beginning, current of each of the LED string (e.g., LED string 308) will be the same as the current $I_{LED_1}$ of the LED string 302, thereby, resulting in the corresponding node voltage $V_{cs_n}$ falls on voltage of the work point P2. In order to reduce unnecessary power loss, the driving current adjusting module 152 based on the work point P1, finds a new point of the LED string 304 on the right side of the suggestion line L2 (including the suggestion line L2 itself), whose voltage is less than the current node voltage $V_{cs_n}$ and whose current is greater than the current $I_{LED_1}$. Premise that the current of the new point will increase, if the current value decreases, of course the new point of the LED string 304 whose current is less than the current $I_{LED_1}$ is selected. The work point P3, the work point P4 or the work point P5 may be selected as the new point. On principle, the work point P3, the work point P4 or the work point P5 can be the new point of the LED string 304, but when the currents of all points on the right side of the suggestion line L2 are the same, corresponding point whose voltage is minimum will fall on the suggestion line L2, thereby, the work point P4 or the work point P5 will be selected as a better new point. Of course, if considering extra work currents, an appropriate new point can be further chosen from the work point P4 or the work point P5.

Assuming the work point P4 is chosen as a new point of the LED string 308 using the above-mentioned method, the LED string 308 will be adjusted to work at a state of its node voltage equaling to $V_{cs_n}$, and its current equaling to $I_{LED_2}$. Therefore, the driving current adjusting module 152 will output corresponding current adjusting signal $I_{set_n}$ to drive the following corresponding switch unit 208. Finally, in order to stabilize output power, the work signal generating module 154 will also gets corresponding cycle adjusting signal PWM_n according to the current adjusting signal $I_{set_n}$ output by the driving current adjusting module 152 and relationship graph as shown in FIG. 3C and outputs the corresponding cycle adjusting signal PWM_n.

Figure 4:
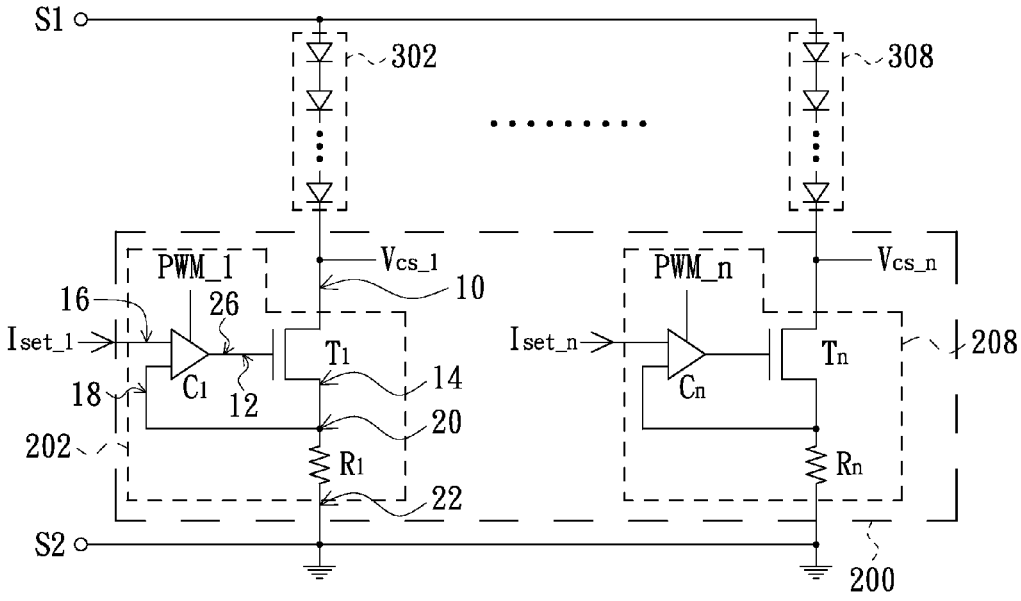
FIG. 4 shows a partial circuit diagram of a switch unit group in accordance with an exemplary embodiment of the present invention.

Next, please refer to FIG. 4, showing a partial circuit diagram of a switch unit group in accordance with an exemplary embodiment of the present invention. As shown in FIG. 4, the switch unit group 200 of this embodiment includes a plurality of switch units 202, . . . , and 208 having the same circuit structures. The switch unit 202 includes a transistor T1, a resistor R1, and a comparator C1. The switch unit 208 includes a transistor Tn, a resistor Rn, and a comparator Cn. Because the switch units in this embodiment have the same circuit structures, the following will take the switch unit 202 for an example to illustrate related circuit coupling relationship and operation process.

In the switch unit 202, a drain 10 of the transistor T1 is electrically coupled to an end (low voltage end) of the corresponding LED string 302. The resistor R1 includes a first pathway terminal 20 and a second pathway terminal 22. The first pathway terminal 20 is electrically coupled to a source 14 of the transistor T1. The second pathway terminal 22 is electrically coupled to the second power supply terminal S2. The comparator C1 includes a first comparison data input terminal 16, a second comparison data input terminal 18, and an comparison result output terminal 26. The comparison result output terminal 26 is electrically coupled to a gate (also called a control terminal) 12 of the transistor T1. The first comparison data input terminal 16 receives the current adjusting signal $I_{set_1}$. The second comparison data input terminal 18 is electrically coupled to the source 14 of the transistor T1.

In operation, assuming voltage level of the first comparison data input terminal 16 of the comparator C1 is greater than voltage level of the second comparison data input terminal 18, when the comparator C1 is enabled, the comparison result output terminal 26 will be at a high level state. At this time, whether the transistor T1 is turned on will be controlled by the cycle adjusting signal PWM_1. In other words, only when the cycle adjusting signal PWM_1 is enabled, the comparator C1 will be enabled to make the comparison result output terminal 26 to output a high level voltage, and the transistor T1 can be turned on. On the contrary, assuming voltage level of the first comparison data input terminal 16 of the comparator C1 is less than voltage level of the second comparison data input terminal 18, when the comparator C1 is enabled, the comparison result output terminal 26 will be at a low level state. At this time, whether the transistor T1 is turned on is irrelevant to the cycle adjusting signal PWM_1.

Generally speaking, the voltage level of the first pathway terminal 20 (or the second comparison data input terminal 18) and voltage level of the drain 10 of the transistor T1 can be regarded as almost the same, that is, are equal to the node voltage $V_{cs_1}$. Therefore, when to increase the current flowing through the LED string 302, the voltage level of the current adjusting signal $I_{set_1}$ will rise to be greater than the original node voltage $V_{cs_1}$, and thereby making turning on or off state of the transistor T1 can be controlled by the cycle adjusting signal PWM_1. When to decrease the current flowing through the LED string 302, the voltage level of the current adjusting signal $I_{set_1}$ will fall to be less than the original node voltage $V_{cs_1}$, and thereby making the transistor T1 be in the turning-off state until the voltage level of the first pathway terminal 20 (or the second comparison data input terminal 18) drops below the voltage level of the current adjusting signal $I_{set_1}$.

From another angle, firstly, the present invention gets a plurality of corresponding node voltages from each of the ends of the LED strings, gets one of these node voltages as a reference node voltage, obtains voltage differences between these node voltages and the reference node voltage, and outputs the voltage differences for a plurality of corresponding feedback voltages. At last, currents flowing through the corresponding LED strings are adjusted according to these feedback voltages. In practical application, the minimum voltage or the maximum voltage of the node voltages can be selected as the reference node voltage. Of course, any other node voltages can also be selected as the reference node voltage, thereby, making the circuit design be relatively complex and increase the difficulty in production.

When to adjust the driving current flowing through the corresponding LED string according to the feedback voltage, firstly, a fixed slope suggestion line should be provided in characteristic curve of driving currents to node voltages of the LED string, and driving current corresponding to the feedback voltage on the suggestion line should be found according to the above-mentioned feedback voltage. Then the work time of the LED string is adjusted according to the got driving current, in order to make the LED string provide default brightness.

It should be noticed that when to find the driving current corresponding to the feedback voltage, only to find any point whose voltage difference between the voltage level of the benchmark point originally set (e.g., the work point P1 as shown in FIG. 3B) is within the corresponding voltage on the right side of the suggestion line (including the suggestion line itself).

In summary, the present invention uses subtractors to eliminate effects of ripple to feedback control, and uses characteristic curve of driving currents to node voltages and feedback voltages to control shine power. Therefore, the invention of the driving power control circuit not only eliminates the ripple and makes feedback control more reliable, but also can reduce unnecessary power loss, and thus reduce the heat evaporating of the electronic components.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driving power control circuit for light emitting diodes (LED) adapted to drive power supplies of a plurality of LED strings, the driving power control circuit comprising:

a first power supply terminal, providing a first output voltage;

a second power supply terminal, providing a second output voltage;

a plurality of switch units, and each of the switch units electrically coupled between one of the LED strings and the second power supply terminal, each of the LED strings is electrically coupled between one of the switch units and the first power supply terminal to make the first power supply terminal, any of the plurality of LEDs, the corresponding one of the plurality of switch units and the second power supply terminal in parallel to form an electronic conducting path; and a control unit, outputting a plurality of adjusting signals to determine whether the switch units are turned on, getting a plurality of node voltages between the plurality of switch units and the plurality of corresponding LED strings, and the control unit comprising:

a voltage selecting module, receiving the plurality of node voltages, selecting one of these node voltages as a reference node voltage, and outputting the reference node voltage;

a subtractor, making the node voltages to subtract the reference node voltage respectively, and outputting corresponding a plurality of feedback voltages; and an adjusting module, determining contents of the adjusting signals according to the feedback voltages.

2. The driving power control circuit as claimed in claim 1, wherein the adjusting module comprises a driving current adjusting module and a work signal generating module; the driving current adjusting module is electrically coupled to the subtractor to receive the plurality of feedback voltages, and determines currents flowing through the plurality of switch units according to the feedback voltages; and the work signal generating module is electrically coupled to the driving current adjusting module, and determines work power sates of the plurality of switch units according to the currents flowing through the plurality of switch units.

3. The driving power control circuit as claimed in claim 2, wherein each of the switch units comprises:

a transistor, comprising a control terminal, a first pathway terminal electrically coupled to the corresponding LED string, and a second pathway terminal;

a resistor comprising one terminal electrically coupled to the second power supply terminal, and the other terminal electrically coupled to the second pathway terminal; and a comparator, comprising a first comparison data input terminal electrically coupled to a reference node voltage, a second comparison data input terminal electrically coupled to the second pathway terminal of the transistor, and an comparison result output terminal electrically coupled to the control terminal.

4. The driving power control circuit as claimed in claim 3, wherein the driving current adjusting module outputs the reference node voltage to the first comparison data input terminal of the comparator.

5. The driving power control circuit as claimed in claim 1, wherein the voltage selecting module selects minimum voltage from these node voltages, and outputs the minimum voltage as the reference node voltage.

6. A driving power control method for light emitting diodes (LEDs), comprising:

getting a plurality of corresponding node voltages from ends of a plurality of LED strings;

getting one of these node voltages as a reference node voltage;

obtaining a plurality of voltage differences between these node voltages and the reference node voltage, outputting the voltage differences as corresponding a plurality of feedback voltages; and adjusting currents flowing through the corresponding LED strings according to these feedback voltages.

7. The driving power control method as claimed in claim 6, wherein the reference node voltage is the minimum voltage of the plurality of node voltages.

8. The driving power control method as claimed in claim 6, wherein the step of adjusting currents flowing through the corresponding LED strings according to these feedback voltages comprising:

providing a fixed slope line in characteristic curve of driving currents to node voltages of LED string; and finding a plurality of driving currents corresponding to the plurality of feedback voltages on the suggestion line according to the feedback voltages.

9. The driving power control method as claimed in claim 8, further comprising: adjusting work time of the LED strings according to the adjusted driving currents, in order to make the plurality of LED strings to provide default brightness.

* * * * *